US011306370B2

(12) United States Patent
Yamamura

(10) Patent No.: US 11,306,370 B2
(45) Date of Patent: Apr. 19, 2022

(54) BLADE MATERIAL

(71) Applicant: Hitachi Metals, Ltd., Tokyo (JP)

(72) Inventor: Kazuhiro Yamamura, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 73 days.

(21) Appl. No.: 16/326,933

(22) PCT Filed: Sep. 6, 2017

(86) PCT No.: PCT/JP2017/032031
§ 371 (c)(1),
(2) Date: Feb. 21, 2019

(87) PCT Pub. No.: WO2018/051854
PCT Pub. Date: Mar. 22, 2018

(65) Prior Publication Data

US 2019/0211418 A1 Jul. 11, 2019

(30) Foreign Application Priority Data

Sep. 16, 2016 (JP) ..... JP2016-181454

(51) Int. Cl.
*C21D 9/18* (2006.01)
*C22C 38/00* (2006.01)
(Continued)

(52) U.S. Cl.
CPC ..... *C21D 9/18* (2013.01); *B26B 9/00* (2013.01); *C21D 8/02* (2013.01); *C22C 38/00* (2013.01);
(Continued)

(58) Field of Classification Search
CPC . C21D 1/18; C21D 6/002; C21D 6/02; C21D 8/0205; C21D 9/18; C21D 9/46; C22C 38/00
(Continued)

(56) References Cited

U.S. PATENT DOCUMENTS 9,783,866 B2 * 10/2017 Fukada ..... C21D 8/0236
2014/0294662 A1 * 10/2014 Ueno ..... C22C 38/04 420/64
2016/0361828 A1 * 12/2016 Xu ..... C21D 9/0068

FOREIGN PATENT DOCUMENTS

CN 105247082 1/2016
DE 3901470 8/1990
(Continued)

OTHER PUBLICATIONS

"Office Action of China Counterpart Application", dated May 9, 2020, with English translation thereof, p. 1-p. 12.
(Continued)

*Primary Examiner* — Jie Yang
(74) *Attorney, Agent, or Firm* — JCIPRNET

(57) ABSTRACT

Provided is a blade material having high strength. The blade material contains, in % by mass, 0.5 to 0.8% of C, 1.0% or less of Si, 1.0% or less of Mn, 11 to 15% of Cr, and 0.1 to 0.8% of V, the remainder includes Fe and inevitable impurities, and has a thickness of 0.5 mm or less, wherein the structure of the blade material as observed after polishing the surface thereof has ferrites and carbides, the carbides have an average particle diameter of 0.5 μm or less, and a proportion of carbides containing V in the carbides is 50% or less in terms of a proportion in an area of a field of view.

3 Claims, 4 Drawing Sheets

(51) Int. Cl.

| | |
|---|---|
| ***C22C 38/24*** | (2006.01) |
| ***B26B 9/00*** | (2006.01) |
| ***C21D 8/02*** | (2006.01) |
| ***C22C 38/02*** | (2006.01) |
| ***C22C 38/12*** | (2006.01) |
| ***C22C 38/18*** | (2006.01) |
| *C21D 9/46* | (2006.01) |
| *C21D 1/18* | (2006.01) |

(52) U.S. Cl.
CPC ..... *C22C 38/02* (2013.01); *C22C 38/12* (2013.01); *C22C 38/18* (2013.01); *C22C 38/24* (2013.01); *C21D 1/18* (2013.01); *C21D 9/46* (2013.01)

(58) Field of Classification Search
USPC ..... 148/325
See application file for complete search history.

(56) References Cited

FOREIGN PATENT DOCUMENTS

| | | |
|---|---|---|
| EP | 2761595 | 8/2014 |
| EP | 2982773 | 2/2016 |
| JP | S484694 | 2/1973 |
| JP | S61276953 | 12/1986 |
| JP | S62116755 | 5/1987 |
| JP | S63250440 | 10/1988 |
| JP | 2000273587 | 10/2000 |
| JP | 2002212679 | 7/2002 |
| JP | 2007063635 | 3/2007 |
| JP | 2014070229 | 4/2014 |
| WO | 2014162997 | 10/2014 |

OTHER PUBLICATIONS

"Office Action of Korea Counterpart Application", dated Jun. 1, 2020, with English translation thereof, p. 1-p. 10.
"Search Report of Europe Counterpart Application", dated Jan. 29, 2020, pp. 1-9.
"International Search Report (Form PCT/ISA/210) of PCT/JP2017/032031," dated Dec. 12, 2017, with English translation thereof, pp. 1-4.
"Office Action of Korea Counterpart Application", dated Nov. 2, 2020, with English translation thereof, pp. 1-10.
"Office Action of China Counterpart Application", dated Nov. 19, 2020, with English translation thereof, p. 1-p. 15.
"Office Action of Korea Counterpart Application" with English translation thereof, dated Apr. 21, 2021, p. 1-p. 7.
"Office Action of China Counterpart Application", dated Mar. 2, 2021, with English translation thereof, p. 1-p. 10.
"Office Action of China Counterpart Application" with English translation thereof, dated Sep. 28, 2021, p. 1-p. 11.
"Office Action of China Counterpart Application" with English translation thereof, dated Jul. 8, 2021, p. 1-p. 12.

* cited by examiner

| No. | AMOUNT OF V (mass%) | CP IMAGE | C | V |
|---|---|---|---|---|
| 1 | 0.2 |  |  |  |
| 2 | 0.47 |  |  |  |
| 11 | 0.94 |  |  |  |
| 12 | 0.02 |  |  |  |

2μm

BLADE MATERIAL

CROSS-REFERENCE TO RELATED APPLICATION

This application is a 371 application of the international PCT application serial no. PCT/JP2017/032031, filed on Sep. 6, 2017, which claims the priority benefit of Japan application no. 2016-181454, filed on Sep. 16, 2016. The entirety of each of the above-mentioned patent applications is hereby incorporated by reference herein and made a part of this specification.

TECHNICAL FIELD

The present invention relates to a blade material.

BACKGROUND ART

In general, martensitic steel is used for blades such as for kitchen knives and razors. In particular, when an appropriate amount of Cr is added, since regular maintenance of martensitic stainless steel having an improved corrosion resistance is facilitated, this martensitic steel is widely used as a steel for blades, and a large amount of research has been conducted thereon to date.

While a blade having sufficient sharpness is an important requirement, it is also very important to maintain the sharpness for a long time. Here, regarding examples of alloys for a blade having good durability, those such as in Patent Literature 1 or 2 have been reported.

CITATION LIST

Patent Literature

[Patent Literature 1]
Japanese Unexamined Patent Application Publication No. 2000-273587
[Patent Literature 2]
Japanese Unexamined Patent Application Publication No. 2002-212679

SUMMARY OF INVENTION

Technical Problem

Both of Patent Literature 1 and 2 disclose a steel for a blade in which sharpness is able to be maintained for a long time with no occurrence of blade splintering, blade chipping, or the like, in which carbides are made to be 5 μm or less.

However, in order for the inventor(s) to improve an alloy for the purpose of improving the durability of a blade, when a razor was used for a long time as a practical blade and a cutting edge was carefully observed after use, it was found that little blade chipping or blade splintering occurred in practice, and that rather, bending of a cutting edge was a major factor as a cause that leads to deterioration of sharpness.

This means that the lifetime of a blade can be extended when bending of the cutting edge is able to be reduced, and for this reason, it is conceivable that improvement in the mechanical strength of an alloy matrix itself may be effective.

An objective of the present invention is to provide a blade material having high strength.

Solution to Problem

The inventor(s) found that searching for alloy elements suitable for increasing a strength of a steel for a blade and utilizing a solid solution strengthening phenomenon by containing V was effective. However, V tends to cause an increase in number of and coarsening of metal carbides contained in an alloy structure of a blade steel, and as a result, a cutting edge tends to become chipped. Here, the present invention was realized by extensively investigating the mechanical properties and precipitation forms of carbides.

That is, the present invention provides a blade material which contains, in mass %, 0.5 to 0.8% of C, 1.0% or less of Si, 1.0% or less of Mn, 11 to 15% of Cr, and 0.1 to 0.8% of V, the remainder including Fe and inevitable impurities, and in which a thickness is 0.5 mm or less.

In the present invention, a structure thereof as observed after polishing a surface may include ferrites and carbides, and an average particle diameter of the carbides may be 0.5 μm or less.

In the present invention, a proportion of carbides containing V in the carbides may be 50% or less in terms of a proportion in an area of a field of view.

In the present invention, a structure thereof as observed after polishing a surface may be a martensitic structure, and a tensile strength thereof may be 2,050 MPa or more.

Advantageous Effects of Invention

The present invention can provide a blade material having a good mechanical strength and in which when used as a blade occurrence of bending of a cutting edge is able to be prevented, and as a result a lifetime of the blade is able to be increased.

DESCRIPTION OF EMBODIMENTS

Figure 1:
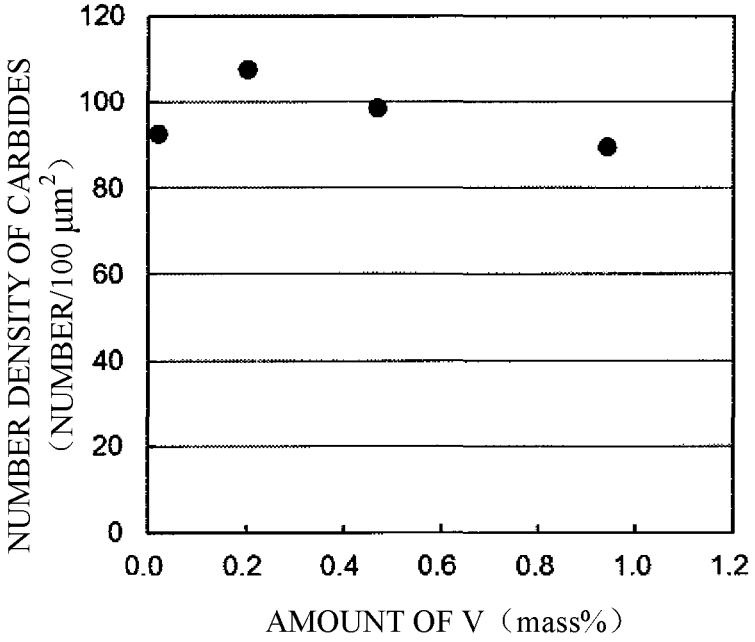
FIG. 1 is a diagram showing a relationship between a number density of carbides and an amount of V contained in a blade material.

As described above, an important characteristic of the present invention is that an appropriate amount of V is contained in a steel for a blade that is a blade material.

In the blade material of the present invention, the reasons for stipulating ranges for the content of elements are as follows. Further, the ranges are represented in mass % unless the context clearly indicates otherwise.

C: 0.5 to 0.8%

The reason for setting a C content to 0.5 to 0.8% is that a sufficient hardness for a blade is thereby achieved and crystallization of eutectic carbides during casting/solidification is reduced to a minimum. When there is less than 0.5% of C, a sufficient hardness for a blade may not be able to be obtained. On the other hand, when an amount thereof exceeds 0.8%, an amount of eutectic carbide increases in a balanced manner with respect to the amount of Cr increases causing blade chipping during blade sharpening. In order to more reliably obtain the above-mentioned effects due to C, a lower limit of C is preferably 0.6%, and an upper limit thereof is preferably 0.7%.

Si≤1.0%

Si is added as a deoxidizing agent during refining. When an amount of Si exceeds 1.0%, since the amount of inclusions increases causing blade chipping during blade sharpening, the upper limit is 1.0%. Meanwhile, while the lower limit is not particularly provided, when sufficient deoxidizing effects are obtained, 0.2% or more of Si will remain. For this reason, a preferable range of Si is 0.2 to 1.0%.

Mn≤1.0%

Like Si, Mn is also added as a deoxidizing agent during refining. Since Mn decreases hot workability when the amount of Mn exceeds 1.0%, an upper limit is 1.0%. While a lower limit is not particularly limited, when sufficient deoxidizing effects are obtained, 0.4% or more of Mn will remain. For this reason, a preferable range of Mn is 0.4 to 1.0%.

Cr: 11 to 15%

The reason for setting 11 to 15% for Cr to is to accomplish a sufficient corrosion resistance and reduce crystallization of eutectic carbide during casting/solidification to a minimum. A sufficient corrosion resistance for a stainless steel cannot be obtained when there is less than 11% of Cr, and an amount of eutectic carbide increases when the amount of Cr exceeds 15%, which causes blade chipping during blade sharpening. In order to more reliably obtain the above-mentioned effects due to Cr, a lower limit of Cr is preferably 12.5%, and an upper limit is preferably 13.5%.

V: 0.1 to 0.8%

V is a most important element in the blade material of the present invention. V exhibits effects of improving a mechanical strength through solid solution strengthening due to V forming a solid solution in a metallic matrix of an alloy. Conventionally, although V is mixed in inevitable impurities in a process of manufacturing steel, since a strengthening mechanism in V does not function when an amount of V is extremely small, 0.1% of V needs to be included as a lower limit in the present invention. Meanwhile, V has an extremely high affinity with C, and V carbide (VC) is easily formed in such high carbon steel of the present invention. When VC is formed, a solid solution strengthening mechanism in a metallic matrix due to V does not function, C which originally formed a solid solution in the metallic matrix is also fixed as VC, and thus, the hardness of the metallic matrix required for a blade is decreased. In addition, when coarse carbides are formed, the coarse carbides cause blade chipping during blade sharpening or during use, and from this viewpoint it is preferable that V not be included in excess. For this reason, a range of V is 0.1 to 0.8%. In order to more reliably obtain the above-mentioned effects due to V, a lower limit of V is preferably 0.15%. A preferable upper limit of V is 0.7%, and an upper limit is more preferably 0.5%.

In addition to the above-mentioned elements, Fe and impurities are used.

Typically, impurity elements include P, S, Ni, Cu, Al, Ti, N and O, and although these elements are inevitably mixed in, in order that these elements do not interfere with the effects of the present invention, it is preferable that there be limitation to the following ranges:

P≤0.03%, S≤0.005%, Ni≤0.15%, Cu≤0.1%, Al≤0.01%, Ti≤0.01%, N≤0.05% and O≤0.05%.

In addition, since the present invention relates to a blade material, a thickness thereof is set to 0.5 mm or less. A more preferable thickness is 0.3 mm or less. While a lower limit of the thickness is not particularly limited, the lower limit is approximately 0.05 mm in consideration of the fact that cold rolling is applied to achieve a final thickness and a rigidity of the blade material is decreased when the thickness is excessively thin.

Since the blade material of the present invention is manufactured using a general melting process represented by high frequency melting, as a process of reducing a thickness, it is preferable to perform plastic working represented by rolling, in which the crystal grains of a metallic matrix is refined and the strength is also improved. It is particularly preferable that the steel ingot after melting be made to have a desired thickness through hot forging, hot rolling and finally cold rolling. Further, for the purpose of softening of the material and adjustment of a carbide size in the course of cold working, annealing can be performed appropriately at about 700 to 900° C. for about 30 seconds to one hour.

Further, in an alloy composition of the present invention, a metal structure in processes from melting to rolling exhibits a structure comprising of ferrites and carbides. An average particle diameter of the carbides is preferably 0.5 μm or less. If the carbides are fine, this is advantageous in that carbides solid solution is likely to occur in the quenching process when a blade is manufactured, and quenching is easily completed in a shorter time. In addition, when an average particle diameter of the carbides exceeds 0.5 μm, coarse carbides are likely to remain even after quenching, and likely to become a cause of blade chipping during a blade sharpening process or during use. For this reason, the average particle diameter of the carbides is preferably such that they are fine, and more preferably, 0.45 μm or less. Further, while the average particle diameter of the carbides is preferably as small as possible and the lower limit is not particularly limited from a viewpoint of mechanical properties of the alloy of the present invention, since a manufacturing process load increases excessively as miniaturization progresses, the average particle diameter is about 0.1 μm in practice.

In addition, since V in the present invention is an element intended to strengthen the solid solution of the metallic matrix, it becomes harder for a solid solution strengthening mechanism in the metallic matrix to function when V is contained in the carbides. Accordingly, in the blade material of the present invention, an upper limit of a proportion of the carbides containing V in the carbides is preferably 50% of less in terms of a proportion in an area of a field of view. More preferably, the upper limit is 20% or less. In addition, since a proportion of the carbides containing V in the carbides is preferably as small as possible, a lower limit is not particularly limited, and the proportion may be 0%.

Here, the proportion of the carbides containing V in the carbides can be calculated in the following procedures.

First, element mapping with respect to C and V in a metal structure comprising ferrites and carbides is performed. In the blade material of the present invention, the elements that can form carbides are Cr and V. That is, it is conceivable that Cr carbide or V carbide, or both will be present at places where concentration of C occurs in the element mapping. Meanwhile, since V forms a solid solution in the metallic matrix or forms V carbide, a place where concentration of V occurs is considered to be V carbide. Accordingly, a proportion of the carbides containing V in the carbides can be obtained in terms of a proportion in an area of a field of view using the following equation.

(Proportion of carbides containing V in carbides) (%)= {(Area in which concentration of V occurs)×100}/(Area in which concentration of C occurs) [Math. 1]

Here, "Area in which concentration of C occurs" is a sum of areas of portions at which C is concentrated (also referred to as C concentration particles), and "Area in which concentration of V occurs" is a sum of areas of C concentration particles, in which concentration of V also occurs. Further, since V preferably forms a solid solution in the metallic matrix as described above and a state in which no V carbide is present becomes 0% in terms of the proportion in an area of a field of view, a lower limit is not particularly provided.

Here, analytical instruments including a wavelength-dispersive X-ray spectroscopic analyzer (WDX) are preferably used in the element mapping. Since C is a light element, clear identification is difficult with an energy-dispersive X-ray spectroscopic analyzer (EDX). In addition, as described above, since the carbides are extremely fine in the blade material of the present invention, for example, when an observation magnification is 5,000 times or more, it is preferable to observe more than two fields of view and measure their average values. A representative procedure for measuring areas in which concentration of C or V occurs is as follows. First, the element map obtained by measurement is represented in grayscale having a total of 256 levels in which a metallic matrix section is black (brightness 0) and the sections most concentrated in C or V are white (brightness 255). Next, regions in which the brightness is 64 or more are taken as regions in which concentration of C or V has occurred, and these areas are measured.

In addition, since the blade material of the present invention needs to have sufficient hardness and strength for a blade, the metal structure thereof needs to exhibit a martensitic structure when used in practice.

As described above, the blade steel material of the present invention exhibits a metal structure that becomes ferrite and carbides in the melting to rolling process, and appropriate quenching-tempering needs to be performed to transform the metal structure into a martensitic structure.

Firstly, the martensitic structure is formed by carbides solution into matrix through a quenching process. But when a quenching temperature is too low, solid solution of carbides is not promoted. Moreover, when the temperature is too high, solid solution of carbides progresses too much, and an amount of remaining austenite is increased in subsequent processes and crystal grains become coarse, as a result, tensile strength and hardness decrease. For this reason, in quenching conditions, rapid cooling is preferably performed after holding for 15 seconds to 5 minutes at 1,050° C. to 1,200° C. Here, in the rapid cooling process, the blade material of the present invention is preferably cooled such that a temperature of the blade material is decreased at a rate of 50° C./second or more from a quenching temperature to room temperature.

Deep freezing treatment is preferably performed subsequently to the quenching treatment. This is because a sufficient tensile strength and hardness can be obtained by transforming the remaining austenite into a martensitic structure. The deep freezing treatment is performed at −70° C. or less, and for example, an operation such as immersing the material in a freezing mixture of dry ice and alcohol or liquid nitrogen, sandwiching the material between metal blocks cooled in liquid nitrogen, or the like, may be performed. Further, a treatment time may be such that the blade material of the present invention is uniformly cooled, and it is sufficient to perform the treatment for 30 seconds to 30 minutes according to a plate thickness thereof. Further, in a cooling process of the deep freezing treatment, the blade material of the present invention may be directly subjected to the deep freezing treatment after holding the blade material at a quenching temperature for a predetermined time as long as a cooling rate sufficient for the rapid cooling process can be obtained.

Finally, a tempering treatment is performed, to restore the toughness of the martensitic structure. Since a sufficient hardness for a blade material may not be able to be obtained when the tempering is performed at too high a temperature, the blade material is preferably held at 150 to 400° C. for 15 seconds to one hour, regarding desirable tempering conditions.

Further, since a heat treatment process other than the above-mentioned tempering is performed at a high temperature, in order to prevent oxidation of the blade material of the present invention, treatment is preferably performed in a non-oxidizing gas such as nitrogen, hydrogen, or the like, or in a vacuum.

In addition, in the blade material of the present invention, the metal structure can be transformed into a martensitic structure by performing the above-mentioned quenching and tempering (according to necessity, deep freezing treatment after quenching). The metal structure can be confirmed to have become a martensitic structure by observation with, for example, an optical microscope.

It is preferable for the blade material with a martensitic structure to have a tensile strength of 2050 MPa or more in order to minimize bending of the cutting edge. For this reason, a lifetime of the blade is lengthened when a tensile strength is 2050 MPa or more. When measuring a tensile strength, in consideration of the fact that the present invention is a blade material, after a desired thickness is obtained, heat treatment such as quenching, tempering, or the like, is appropriately performed to transform the metal structure into a martensitic structure, a test sample is fabricated in a state in which a rolling direction is set to a test direction, and then, the test sample is preferably measured with a plate tension test pursuant to JIS-Z2241.

EXAMPLES

The present invention will be described in more detail with reference to the following examples.

10 kg steel ingots was made with vacuum melting, and hot forging was performed thereon. After that, plates having a thickness of 1 mm were cut out therefrom, and annealing and cold rolling were repeated to make a test specimen having a thickness of 0.1 mm. Chemical compositions are shown in Table 1.

TABLE 1

(mass %)

| No. | C | Si | Mn | Cr | V | Remainder | Remarks |
|---|---|---|---|---|---|---|---|
| 1 | 0.70 | 0.27 | 0.73 | 13.3 | 0.20 | Fe and inevitable impurities | Present invention |
| 2 | 0.69 | 0.26 | 0.68 | 13.3 | 0.47 | Same as above | Present invention |

TABLE 1-continued

| (mass %) | | | | | | | |
|---|---|---|---|---|---|---|---|
| No. | C | Si | Mn | Cr | V | Remainder | Remarks |
| 11 | 0.69 | 0.28 | 0.71 | 13.3 | 0.94 | Same as above | Comparative example |
| 12 | 0.70 | 0.27 | 0.73 | 13.2 | 0.02 | Same as above | Comparative example |

First, the fabricated test material was heated in $H_2$ at 770° C. for 30 seconds, and an annealed specimen was made. In order to perform evaluation of carbides, after a surface of the annealed material was electrolytic polished to form a mirror surface, etching was performed using a ferric chloride solution, and microstructure observation was performed using a scanning electron microscope. After observing each of five fields of view for each sample at an observation magnification of 10,000 times, an area proportion, number, and average particle diameter seen in an area of a field of 100 $\mu m^2$ (the number average equivalent circle diameter of carbides) of carbides was measured through image analysis. The carbides as a measurement target were carbides having an equivalent circle diameter of 0.1 μm or more that were able to be recognized with a magnitude of 10,000 times. Evaluation results for the carbides are shown in FIGS. 1 to 3.

Figure 2:
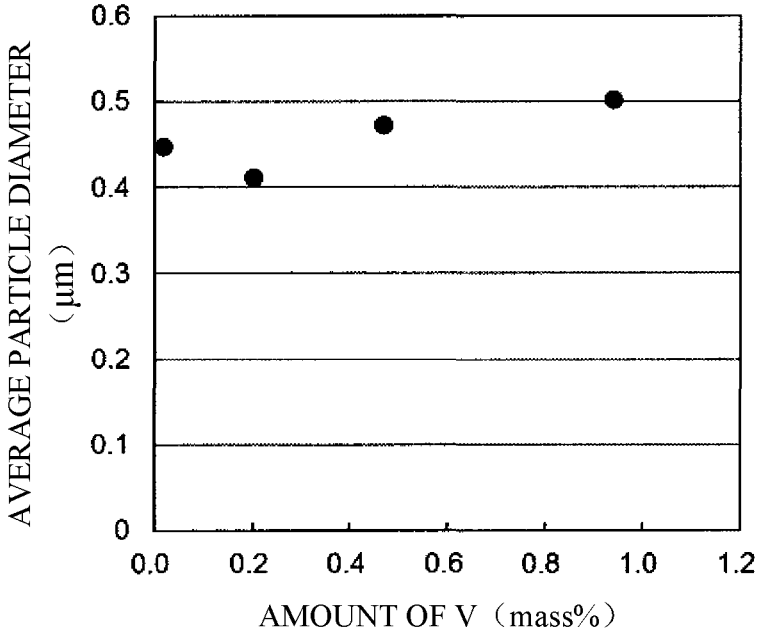
FIG. 2 is a view showing a relationship between an average particle diameter of carbides and an amount of V contained in a blade material.
Figure 3:
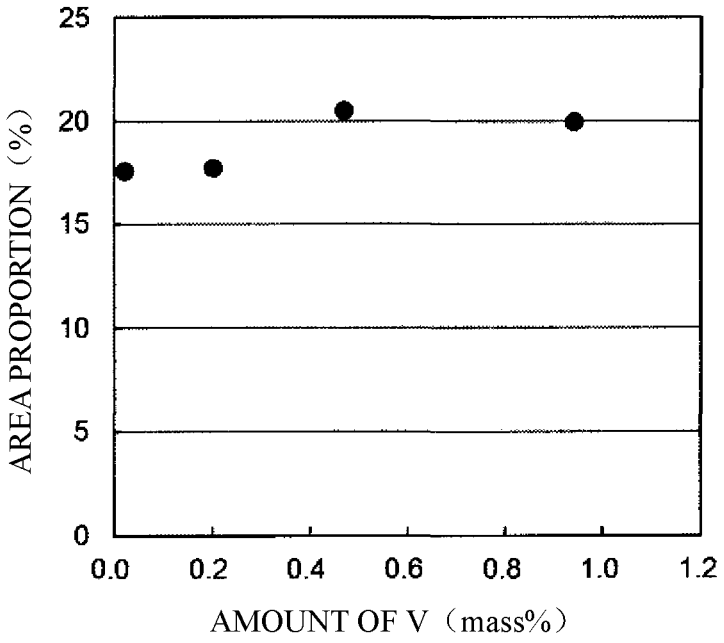
FIG. 3 is a view showing a relationship between an area proportion of carbides and an amount of V contained in a blade material.

While the evaluation results of FIGS. 1 to 3 show a trend in which the number of carbides per 100 $\mu m^2$ decreases as the amount of V increases, in contrast the average particle diameter had a trend of increasing. In addition, the area proportion also had a trend of increasing with the amount of V, and it is thought that since an affinity between V and C increased, carbide (VC) containing V was formed particularly when the amount of V exceeded 0.5%, and carbides coarsened.

Figure 4:
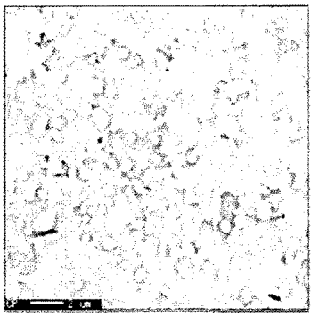
FIG. 4 is a view showing an example of an element map of C and V of a blade material.
Figure 4:
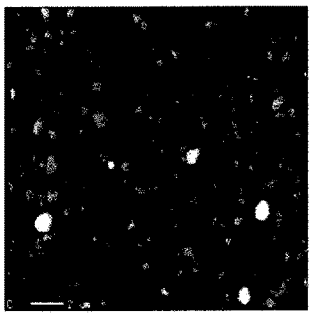
Figure 4:
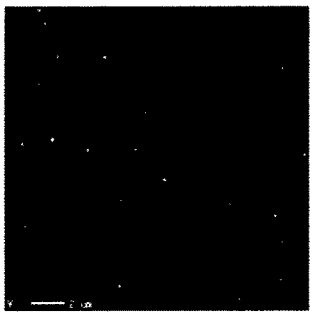
Figure 4:
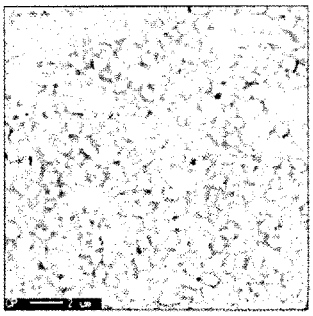
Figure 4:
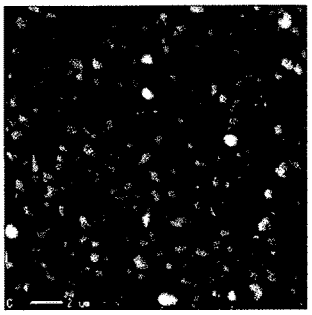
Figure 4:
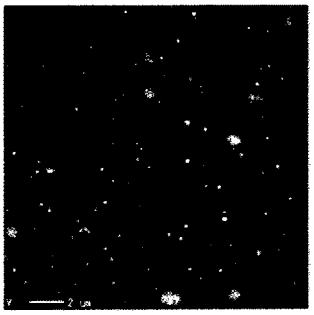
Figure 4:
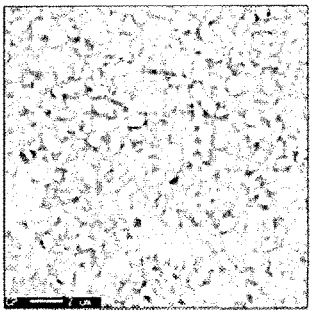
Figure 4:
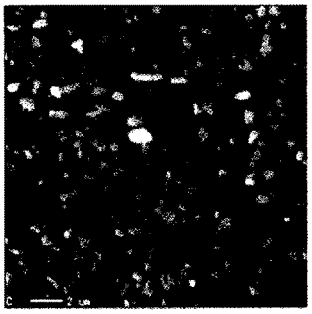
Figure 4:
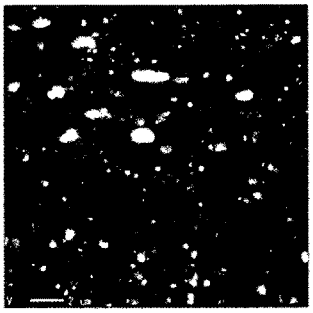
Figure 4:
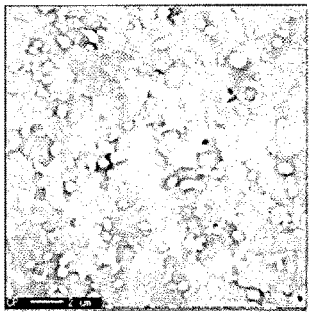
Figure 4:
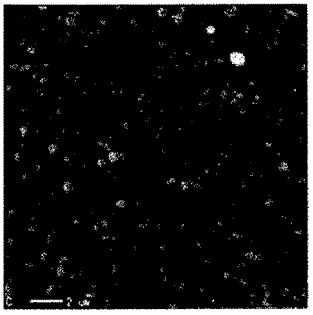
Figure 4:
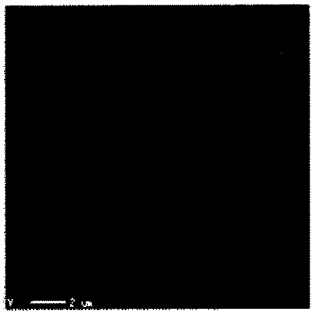

Next, a distribution of V in the alloy was investigated using FE-EPMA with WDX using the samples used for carbide analysis. Since it is thought that V may solute into the metallic matrix or precipitate as carbide (VC) containing V, an example of element mapping is shown in FIG. 4 together with a distribution of C, and a proportion of carbides containing V in the carbides is shown in terms of a proportion in an area of a field of view in Table 2 obtained by measurement using a procedure disclosed as above.

In the results in Table 2, a proportion containing V in the carbides increases as V increases, and it is thought that carbide (VC) containing V is formed.

TABLE 2

| No. | Amount of V (mass %) | Proportion of carbides containing V |
|---|---|---|
| 1 | 0.20 | 1.9 |
| 2 | 0.47 | 15.0 |
| 11 | 0.94 | 100 |
| 12 | 0.02 | 0 |

Next, a heat treatment was performed on the annealed specimen, and the metal structure was transformed into a martensitic structure. First, after the annealed material was heated in Ar at 1,100° C. for 40 seconds, the test sample was sandwiched between steel plates at room temperature, and a quenching treatment was performed thereon. Next, after the test sample was held at −77° C. for 30 minutes and a deep freezing treatment was performed, the test sample was held in the atmosphere at 150° C. for 30 seconds, and tempering was performed by further holding at 350° C. for 30 minutes to make a tempered specimen.

Next, various test samples were taken from the fabricated tempered specimens. For a tensile test sample, a test sample for JIS 14B was taken such that a rolling direction was a test direction, and tensile tests were performed on two test samples for each composition at room temperature. In addition, a surface of the tempered specimen was electrolytic polished to form a mirror surface, and Vickers hardness measurement was performed (a load of 300 g, and an average at five points). These results are shown in FIGS. 5 and 6.

Figure 5:
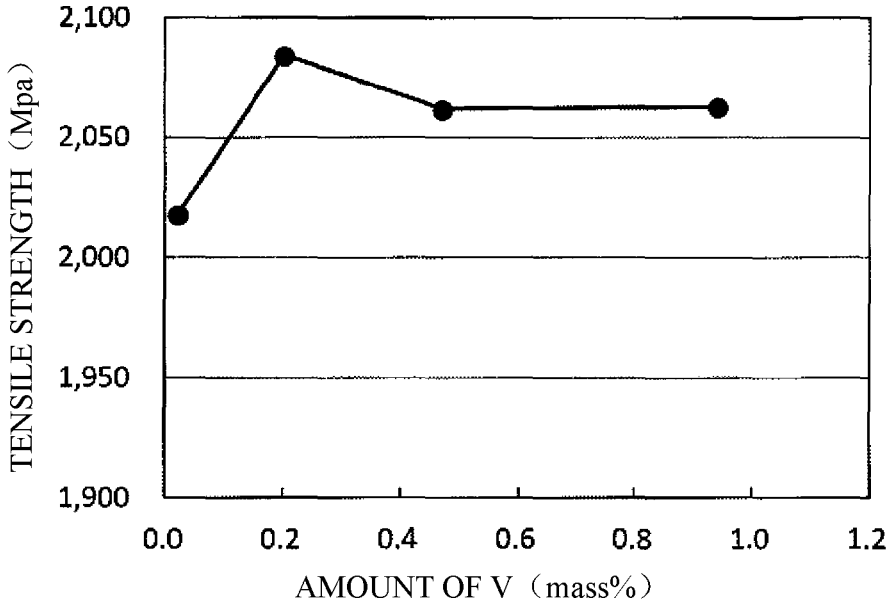
FIG. 5 is a view showing a relationship between a tensile strength of a blade material and an amount of V.
Figure 6:
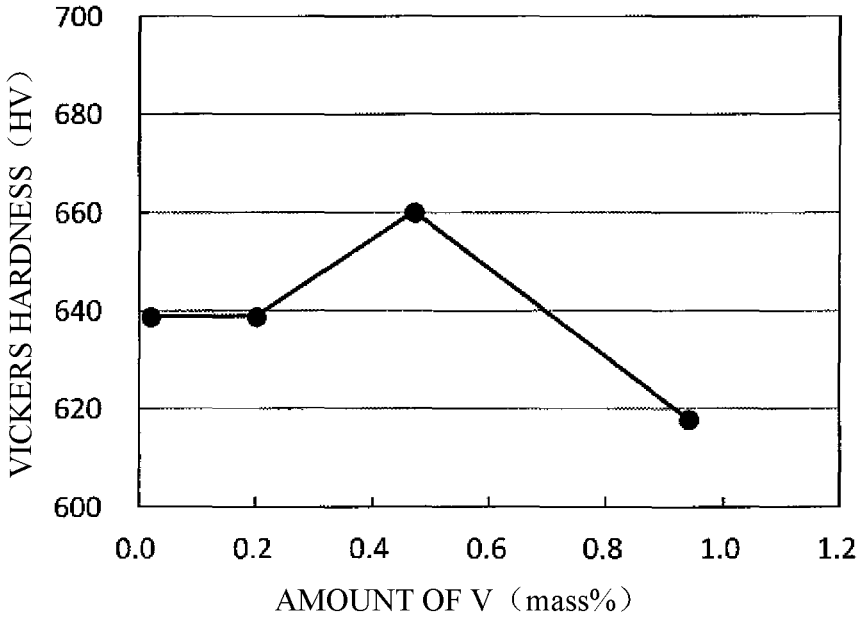
FIG. 6 is a diagram showing a relationship between a hardness of a blade material and an amount of V.

In the results in FIGS. 5 and 6, when a tensile strength of the alloy of the present invention was 2,050 MPa or more and 0.1% or more of V was contained, a tensile strength was significantly improved in comparison with the comparative example. However, when the amount of V exceeded 0.2%, the tensile strength decreased slightly. Next, while the highest result for the hardness was obtained when the amount of V was 0.47%, the hardness decreased when the amount of V was 0.94%. These phenomena are thought to be interrelated with precipitation of the above-mentioned carbide (VC) containing V.

That is, since V precipitates as a carbide (VC) containing V rather than making a metallic matrix, a solid solution strengthening mechanism in V does not function, and the hardness of a martensitic matrix decreases due to decrease in the amount of C forming a solid solution in the metal structure.

INDUSTRIAL APPLICABILITY

The present invention is appropriate for various blade materials such as for kitchen knives, knives, razors, and so on, because hardness and tensile strength after quenching are excellent.

The invention claimed is:

1. A blade material which consists of, in mass %, 0.6 to 0.8% of C, 1.0% or less of Si, 1.0% or less of Mn, 11 to 15% of Cr, and 0.1 to 0.8% of V, the remainder comprising Fe and inevitable impurities, and in which a thickness is 0.5 mm or less, wherein a structure thereof includes ferrites and carbides as observed after polishing a surface thereof, and an average particle diameter of the carbides is 0.5 μm or less, and a proportion of carbides containing V in the carbides is 1.9% or more to 20% or less in terms of a proportion in an area of a field of view.

2. The blade material according to claim 1, wherein a structure obtained by at least quenching and tempering the blade material, which is observed after polishing a surface of the blade material has a martensite structure, and a tensile strength is 2,050 MPa or more.

3. A manufacturing process of a blade material, comprising:

at least quenching and tempering the blade material according to claim 1, and polishing a surface of the blade material after processing the at least quenching and tempering, wherein a structure of the surface after polishing has a martensite structure, and a tensile strength is 2,050 MPa or more.

* * * * *